US007784457B2

(12) United States Patent
Akdag et al.

(10) Patent No.: US 7,784,457 B2
(45) Date of Patent: Aug. 31, 2010

(54) OVEN

(76) Inventors: Levent Akdag, E5 Arcelik A.S., Ankara Asfalti Uzeri, Tuzla, Istanbul (TR) 34950; Bertan Bayram, E5 Arcelik A.S., Ankara Asfalti Uzeri, Tuzla, Istanbul (TR) 34950; Deniz Seker, E5 Arcelik A.S., Ankara Asfalti Uzeri, Tuzla, Istanbul (TR) 34950; Levent Oner, E5 Arcelik A.S., Ankara Asfalti Uzeri, Tuzla, Istanbul (TR) 34950; Haluk Karatas, E5 Arcelik A.S., Ankara Asfalti Uzeri, Tuzla, Istanbul (TR) 34950

( * ) Notice: Subject to any disclaimer, the term of this patent is extended or adjusted under 35 U.S.C. 154(b) by 784 days.

(21) Appl. No.: 10/596,942

(22) PCT Filed: Dec. 29, 2004

(86) PCT No.: PCT/IB2004/052937

§ 371 (c)(1),
(2), (4) Date: Feb. 7, 2007

(87) PCT Pub. No.: WO2005/066549

PCT Pub. Date: Jul. 21, 2005

(65) Prior Publication Data

US 2009/0013987 A1 Jan. 15, 2009

(30) Foreign Application Priority Data

Dec. 30, 2003 (TR) ..... A 2003/02340

(51) Int. Cl.
*F24C 15/32* (2006.01)
*A21B 1/26* (2006.01)

(52) U.S. Cl. ..... 126/21 A; 126/21 R

(58) Field of Classification Search ..... 126/21 A, 126/21 R

See application file for complete search history.

(56) References Cited

U.S. PATENT DOCUMENTS

| | | | | | |
|---|---|---|---|---|---|
| 3,626,922 | A | | 12/1971 | Borge | |
| 3,710,775 | A | | 1/1973 | Ja et al. | |
| 4,357,522 | A | * | 11/1982 | Husslein et al. | 219/400 |
| 4,484,561 | A | * | 11/1984 | Baggott et al. | 126/21 A |
| 4,515,143 | A | | 5/1985 | Jabas | |
| 4,834,063 | A | * | 5/1989 | Hwang et al. | 126/21 A |
| 5,309,981 | A | | 5/1994 | Binder | |
| 5,365,039 | A | * | 11/1994 | Chaudoir | 219/401 |

(Continued)

FOREIGN PATENT DOCUMENTS

DE 19545993 A1 * 6/1997

(Continued)

*Primary Examiner*—Kenneth B Rinehart
*Assistant Examiner*—Frances Kamps
(74) *Attorney, Agent, or Firm*—Venable, Campillo, Logan & Meaney PC

(57) ABSTRACT

The oven (1) which is the object of the present invention, comprises an outer cabinet (2) preferably in a rectangular prism shape, a cooking chamber (3) located inside this outer cabinet with spacing between, fan(s) (9) moving the air inside the oven, heater(s) (10) that heat the air, a fan cladding (11) located at the back of the cooking chamber (3) that directs the air moved by the fan, a side wall (4) enabling the transfer of the air moved by the fan and received from the inlet, towards the middle and the back sections of the cooking chamber at required temperature and pressure rates.

16 Claims, 5 Drawing Sheets

U.S. PATENT DOCUMENTS

Figure 1:
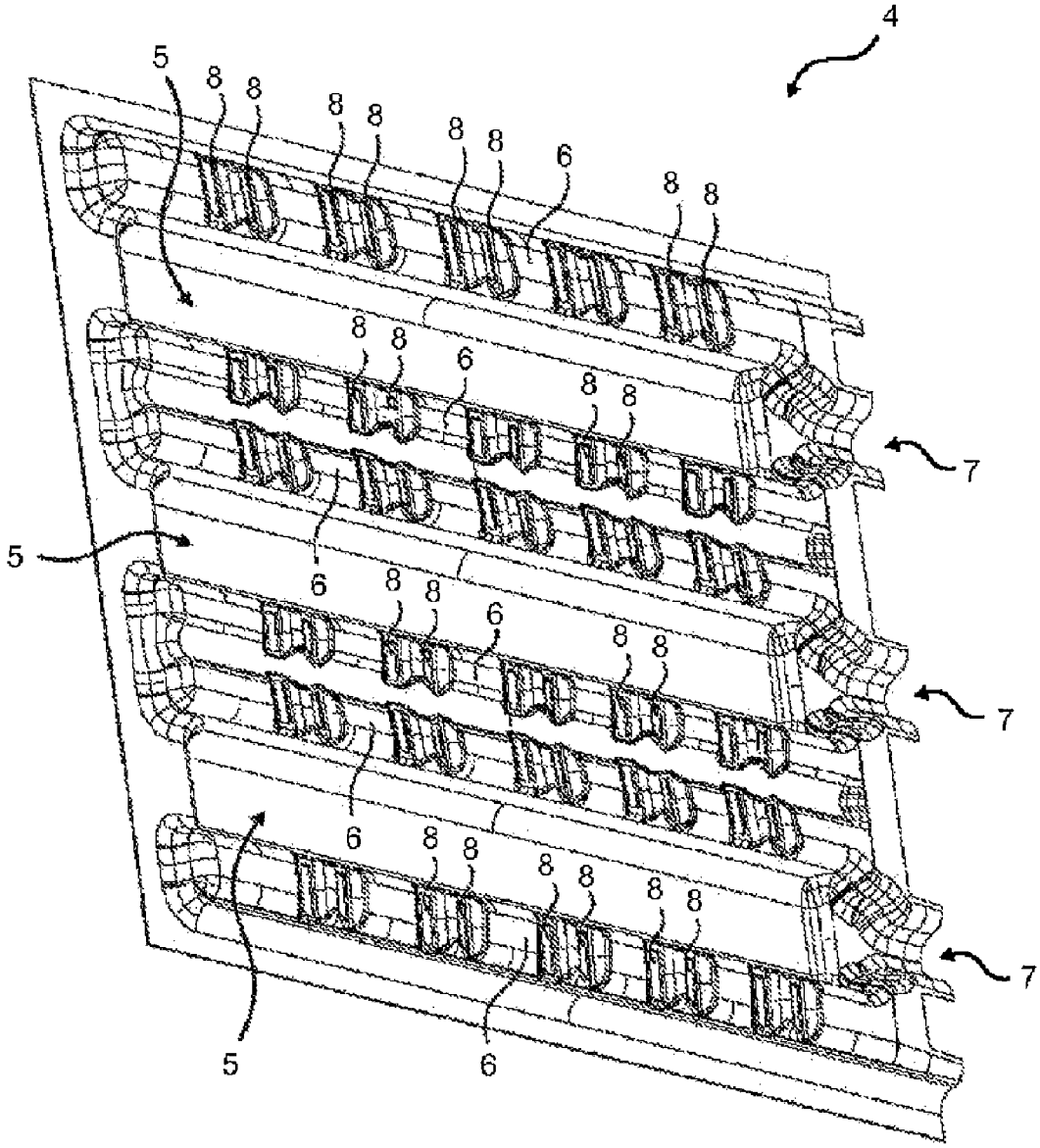

| | | | | |
|---|---|---|---|---|
| 5,440,101 | A * | 8/1995 | Cox et al. | 219/388 |
| 5,615,603 | A | 4/1997 | Polin | |
| 5,816,234 | A | 10/1998 | Vasan | |
| 6,545,251 | B2 * | 4/2003 | Allera et al. | 219/394 |
| 6,717,114 | B2 * | 4/2004 | Austin et al. | 219/400 |
| 7,329,838 | B2 * | 2/2008 | Song et al. | 219/400 |
| 2003/0047553 | A1 * | 3/2003 | Patti et al. | 219/400 |
| 2004/0211765 | A1 * | 10/2004 | McFadden | 219/400 |

FOREIGN PATENT DOCUMENTS

| | | | |
|---|---|---|---|
| DE | 19831087 | A1 * | 1/2000 |
| EP | 0611524 | A | 8/1994 |
| GB | 2105459 | A * | 3/1983 |
| GB | 2226400 | A * | 6/1990 |
| IT | EP 0695915 | * | 2/1996 |

* cited by examiner

OVEN

This invention relates to an oven that provides more efficient and more homogeneous cooking of food placed inside.

There are one or more heater provided for ovens where cooking operation is carried out by convection method, and food is cooked as a consequence of heat transfer realized among the molecules of the food that is desired to be cooked and air molecules heated by this oven. Air molecules close to the heaters are hot whereas, in the parts further away they tend to be cold. For this reason, cooking operations can not be realized homogeneously. In order to solve the problem encountered during cooking operations, a fan is placed on the back plate of the cooking chamber, hence, by operating this fan it is provided that, air molecules heated by heaters are spread homogeneously inside the cooking chamber and heat transfer between hot air molecules and molecules of food that is desired to be cooked is increased.

The part of the cooking chamber that is in contact with outside environment is the frontal part where the door of the oven is located. Although the door being utilized has thermal insulation, inside the cooking chamber, the part that is closest to the door is always colder than other parts. For this reason or similar reasons, it is very difficult to provide homogeneous air dispersion inside the cooking chamber.

For the ovens, various methods are developed in order to provide homogeneous air dispersion inside the cooking chamber.

In the current state of art, U.S. Pat. No. 3,626,922 describes an oven that has apertures located on the side walls of the cooking chamber. Air set in motion by the fan penetrates through these apertures reaching the cooking chamber. Moreover, there is a reflector directing the air inside the volume where the fan is located, towards the apertures located on the side walls of the cooking chamber and there is a passage between the side walls where the air is blown through and the volume where the fan is located.

In the current state of art, German Patent DE3329855 application describes an oven where the heating means are positioned surrounding the walls of the cooking chamber and where the apertures are located on the base and on both side walls of the cooking chamber.

In the current state of art, U.S. Pat. No. 4,515,143 describes an oven that has channels that are mounted on the side walls, containing apertures which provide air to be blown in an upward direction and heaters on the back.

In the current state of art, another U.S. Pat. No. 5,309,981 describes an oven where heaters are placed between the outer walls of the oven and the side walls of the cooking chamber, and apertures are located on the side walls of the cooking chamber. Therefore, sections having different temperatures are minimized inside the cooking chamber.

On the other hand, in the current state of art, in the German Patent Application DE19545993, entitled "Back- and Bratofan", invented by Erich Gunther and Richard Turek, a description is given of apertures in varying number, form and shape that are located on the side walls of the cooking chamber.

In the current state of art, another U.S. Pat. No. 5,816,234 describes an oven where apertures are drilled on the side walls. These apertures are lined up between shelves and above them deflector plates are positioned providing air to be blown in a downward direction.

In the current state of art, German Utility Model Application 29907113, entitled "Anlage zum Rauchern, Kochen, Klimatisieren, Reifen, Kuhlen and Backen", and applied for by Ness & Co. GmbH, also describes an oven where apertures are located on the side walls of the cooking chamber. However, in this application, apart from others, active deflector plates are located between the outer walls of the oven and the side walls of the cooking chamber where air moved by the fan, located on the back plate of the cooking chamber, is directed inside the cooking chamber.

Located on the side walls of the cooking chamber and as mentioned above, in order to provide air to be blown through the apertures or channels located on the side walls towards the cooking chamber, channeling air that is moved by the fan, structures referred as "fan cladding" are developed and located generally on the back of the cooking chamber.

In the current state of art, U.S. Pat. No. 4,357,522 describes deflector plates that are positioned on the back plate and that direct air which is moved by the fan.

In the current state of art, British Patent Application 2105459 mentions apertures lined up vertically on both sides of the back plate where air suction openings are located in the middle.

In the current state of art, British Patent 2226400 describes a fan cladding has a detachable structure and has spaces on the sides.

In the current state of art, German Patent DE4007198 describes a fan cladding where the part that is adjacent to the fan is in a funnel shape where its mouth widens towards the cooking chamber. Besides, in this patent, deflector plates of various shapes and dimensions that are located between the fan cladding and cooking chamber are described.

In the current state of art, European Patent Application 0695915, entitled "Fan-assisted oven with improved air circulation", invented by Ronald Ekinge, describes a fan cladding where the air suction part has circular and elliptical cross sectioned apertures, where each corner of the surface facing inside the cooking chamber; however, has elliptically cross sectioned apertures lined up side by side at an arc length and at certain angles.

In the current state of art, German Patent DE19831087 describes a fan cladding comprising deflector plates of various shapes that are surrounding the parts where air suction apertures reside. The side of this fan cladding is in a groove shape.

The aim of this invention is to realize an oven that provides homogeneous and efficient cooking operation of foods desired to be cooked by accommodating a homogeneous air distribution inside the cooling chamber.

Figure 2A:
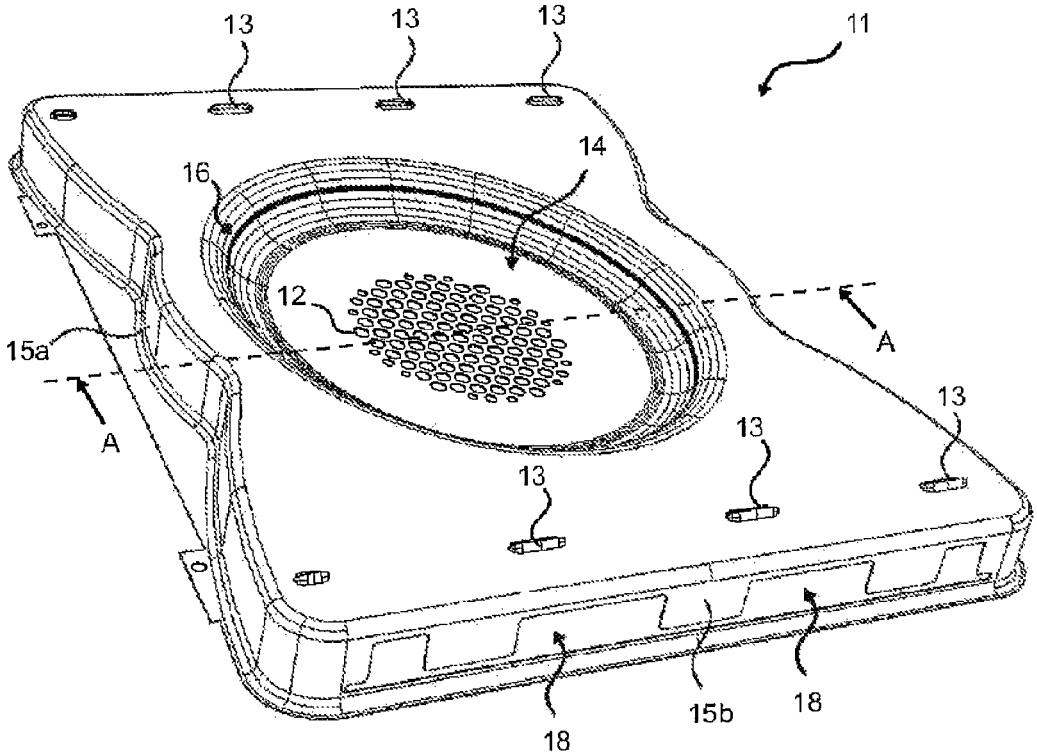
Figure 2B:
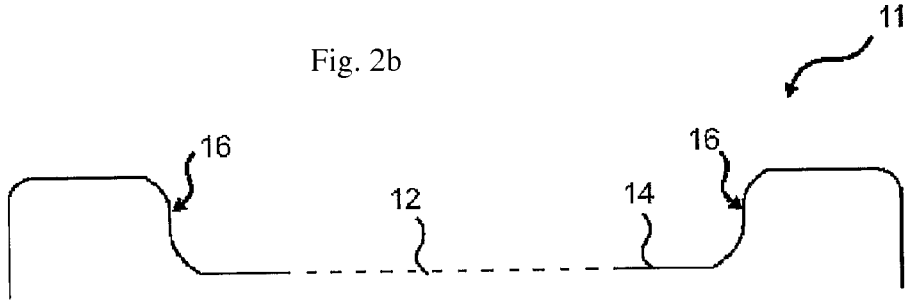
Figure 3:
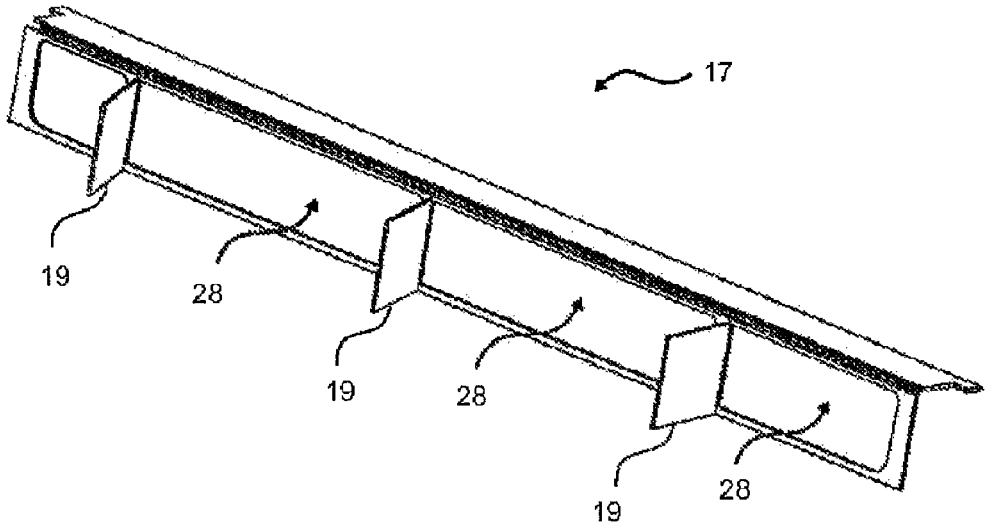
Figure 4:
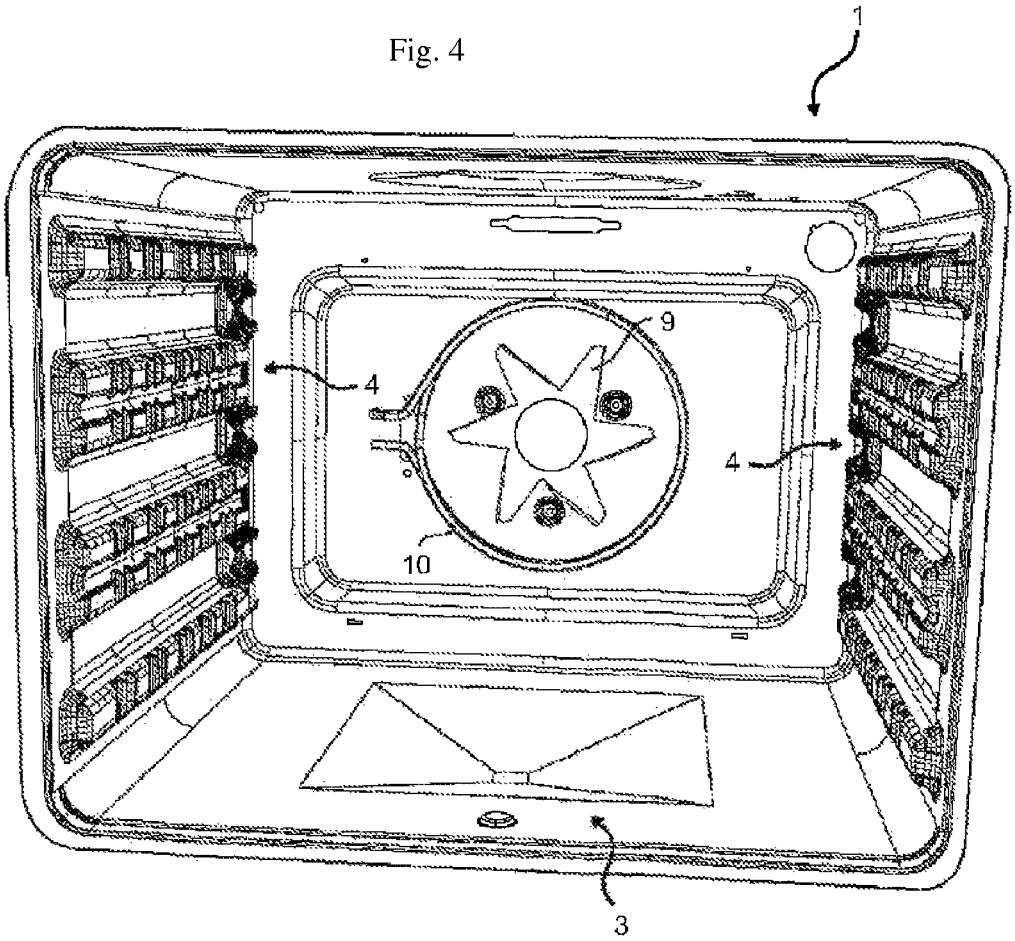
Figure 5A:
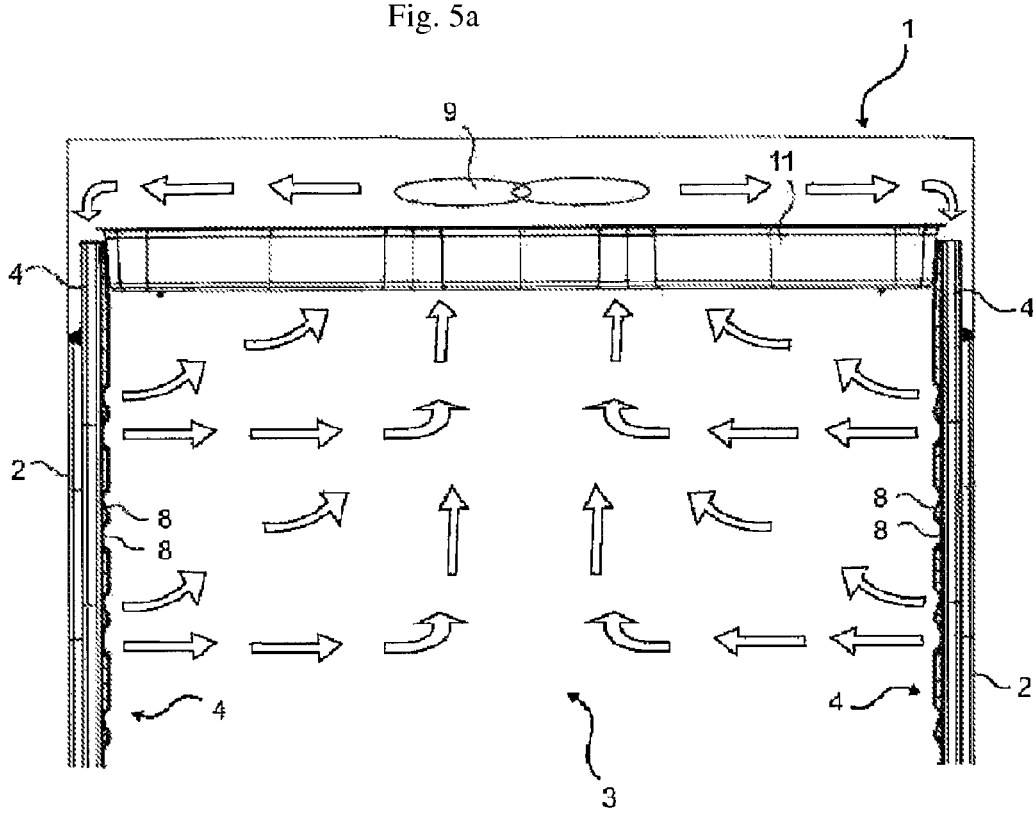
Figure 5B:
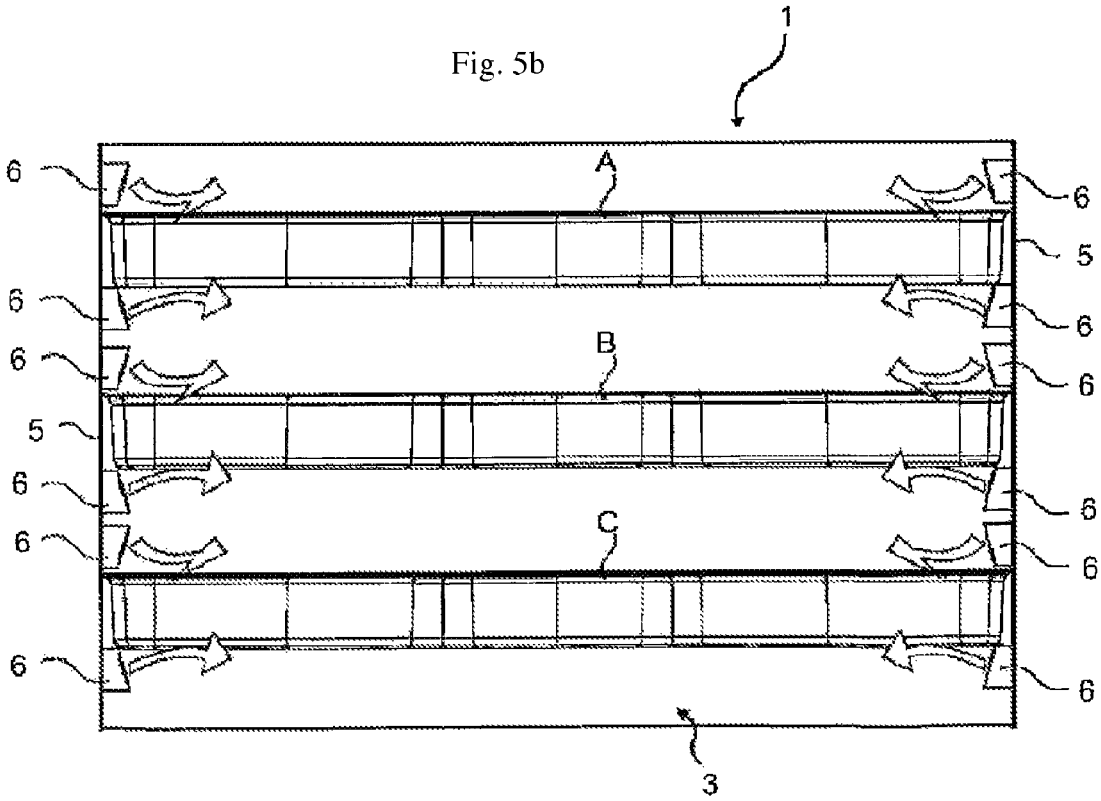
Figure 6:
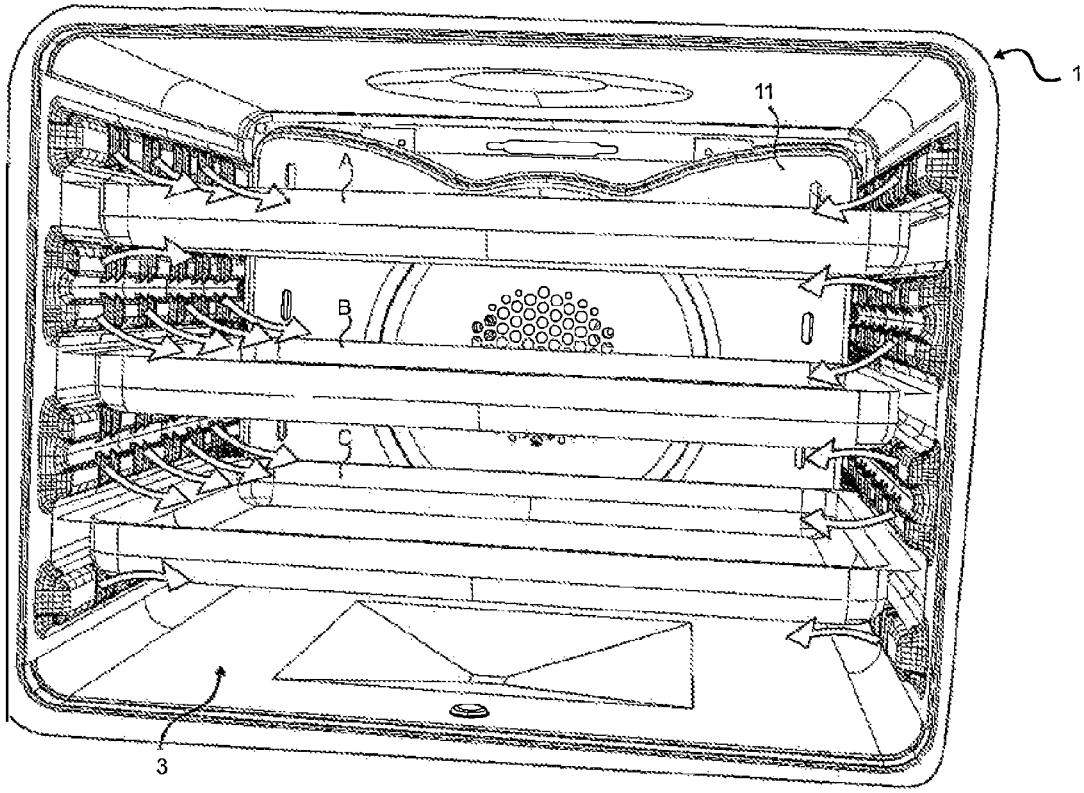

The oven realized in order to attain the object of this invention has been illustrated in the attached figures, where:

FIG. 1 is a perspective view of a side wall,

FIG. 2*a* is a perspective view of a fan cladding,

FIG. 2*b* is a cross-sectional view of a fan cladding, cross-sectional view being taken along the line A-A, FIG. 3 is a perspective view of a take-off piece, FIG. 4 is a perspective view of an oven, FIG. 5*a* is a top view of an oven, FIG. 5*b* is a frontal view of an oven, FIG. 6 is a schematic view of the air flow inside the cooking chamber of the oven.

Parts shown in the drawing numbered one by one as follows:

1—Oven
2—Outer cabinet
3—Cooking chamber
4—Side wall
5—Bearing surface
6—Duct
7—Inlet
8—Aperture
9—Fan

10—Heater
11—Fan cladding
12—Suction aperture
13—Blowing aperture
14—Recess
15*a*, 15*b*—Side
16—Recess edge
17—Take-off piece
18—Opening
19—Deflector plate
28—Window Oven (1), comprises an outer cabinet (2) preferably in a rectangular prism shape, a cooking chamber (3) located inside this outer cabinet (2) with spacing between, one or more fan (9) moving the air inside the oven (1), one or more heater (10) that heats the air, a fan cladding (11) located at the back of the cooking chamber (3) that directs the air moved by the fan (9), one or more bearing surface (5) carrying the plates (A, B, C) placed inside the cooking chamber (3), one or more side wall (4) having one or more duct (6) that transfers the air, that is moved by the fan (9) and received from the inlet, towards the middle and the back sections of the cooking chamber (3) at required temperature and pressure rates (FIG. 4).

Side wall (4) can preferably be mounted on both sides of the cooking chamber (3). Duct (6) residing on the side wall (4) is in a "U" form and extends inside the cooking chamber (3) and is located along the horizontal axis. Duct (6) comprises one or more apertures (8) that are lined up at a distance in between, and that provides air moved by a fan (9) and directed by a fan cladding (11) to circulate towards the middle and the back of the cooking chamber (3), contacting the top and bottom surface of the plate placed, and an inlet (7) that opens to the volume where the fan (9) is located and that lets inside the air directed (FIG. 1). Air heated by the heater (10) and moved by the fan (9) passes through the channel inlet (7) and is blown towards the top surface of the plate through the duct (6) located over the bearing surface (5) and resting along the side wall (4) and also towards the bottom surface through the apertures (8) located over the duct (6) placed below. With the help of the air blown, foods inside the plate are cooked homogeneously (FIG. 5*a*, FIG. 5*b* and FIG. 6).

Dimensions and shapes of the apertures (8) over the duct (6) can be same or can be different. An alternative application of the invention suggests that dimensions of the apertures (8) over the duct (6) vary as they are get further away from the inlet (7). For the preferred application of the invention, temperature, pressure and similar rates of air blown through each aperture (8) over the duct (6) are kept similar as much as possible.

Ducts (6) can be connected by inlets (7) or they can be independent. When channel inlets (7) are connected to each other, air having the same temperature rates is transferred inside the cooking chamber (3). When channel inlets (7) are independent; however, air having different temperature rates can be transferred to the cooking chamber (3).

Fan cladding (11) is a plate comprising of a surface and twisted sides surrounding this surface (15*a* and 15*b*). Fan cladding (11) is placed at the back of the cooking chamber (3) and in front of the fan (9). The part of the fan cladding (1) that faces adjusted the sweeping surface of the fan (9) comprises a recess (14) that preferably has a circular surface. There is a curved recess edge (16) between the surface of the fan cladding (11) and the base of the recess (14) narrowing towards the base from the surface. The cross-sectional view of the recess edge (16) is preferably in an "S" form. As a result of the curved structure of the recess edge (16), flow of air sucked and blown by the fan (9) is more efficient. Fan cladding (11) comprises one or more suction aperture (12) located in the middle of recess (14), in a shape and dimension as it would cover the sweep area of the fan (9), preferably having a circular cross-section, providing the air inside to be sucked by the fan (9), connecting the volume where the fan (9) locates and the cooking chamber (3) and one or more blowing aperture (13) opening towards the cooking chamber (3) over the surface and located on both sides of the recess (14) (FIG. 2*a* and FIG. 2*b*).

The sides (15*a*) of the fan cladding (11) has a butterfly structure characterized by an arc which suits the structure of the recess (14) which is in the centre of the fan cladding (11) and an incline that increases towards the sides (15*b*) and that connects both sides of this arc to the sides. With the butterfly structure of the sides (15*a*) air is equally directed towards both side walls (4) of the cooking chamber (3). Structures in a similar form as the sides (15*a*) of the fan cladding (11) can be attached on the fan cladding (11) afterwards. Therefore, the sides (15*a*) of the fan cladding (11) can be straight.

Both sides (15*b*) of the fan cladding (11) comprises one or more opening (18) enabling the inlet (7) to be opened towards the volume where the fan (9) locates. Inlets (7) are connected directly through these openings (18) to the inside of the volume where the fan (9) locates and further enable the air moved by the fan (9) and directed towards the sides (15*b*) by the fan cladding (11) to be transferred inside the duct (6) attached to the side walls (4).

The oven (1) comprises a take-off piece (17) having one or more window (28) enabling the air moved by the fan (9) and directed by the fan cladding (11) to be transferred inside the duct (6) attached to the side walls (4) where the inlet (7) opens and one or more deflector plate (19) located on these windows (28) (FIG. 3). This take-off piece (17) is mounted over a fan cladding (11) in a way that windows (28) residing on and openings (18) on the sides (15*b*) of the fan cladding (11) intersect.

When plates (A, B, C) placed inside the oven (1) are required to be heated at different temperature rates at the same time, air having different temperature rates needs to be transferred inside the cooking chamber (3). In order to achieve this, heaters (10) having different power rates are placed in front of the windows (28) located on the take-off piece (17) or openings (18) formed on the sides (15*a*) of the fan cladding (11). Therefore, it is provided that air having different temperature rates is blown from each duct (6) located on the side wall (4). In one application of the invention, heaters (10) with same power rates are utilized.

In an alternative application of the invention, heater (10) is placed inside the ducts (6). As well as placing heaters (10) with same power rates, heaters (10) with different rates can also be placed inside each duct (6). Under the circumstances, air having the same temperature rates throughout and moved by a fan (9), reaches a duct (6) by passing through the inlet (7), and is heated to different temperatures by heaters (10) having different power rates and located inside the duct (6) and is transferred through apertures (8) located on each duct (6) towards the cooling chamber (3). Consequently, plates (A, B, C) placed on bearing surfaces (5) located in between each duct (6) are heated by air having different temperature rates.

Side wall (4) is preferably attached to the cooking chamber (3) afterwards. It can be removed from or attached inside the oven (1) if desired by the user. This property eases the cleaning of the side wall (4). Side wall (4) can be attached to the cooking chamber (3) afterwards or at least one wall surrounding the cooking chamber (3) can be formed similar to the side wall (4). In addition to the air blowing duty of the duct (6), it can further be utilized as a bearing surface (5) where the plates are placed.

Since the side wall (4) has a symmetric form, it can be attached on both sides of the cooking chamber (3) providing conservation of time and workmanship on the production of a side wall (4).

In the oven (1) which is the object of the present invention, it is provided that food is cooked homogeneously and efficiently by blowing through apertures (8) residing over ducts (6) from the duct (6) located over the bearing surface (5) that lays along the side wall (4) to the top surface of the plate and from the duct (6) located under towards the bottom surface of the plate.

The invention claimed is:

1. An oven (1) comprising an outer cabinet (2), a cooking chamber (3) located inside this outer cabinet (2) with spacing in between, one or more fan (9) moving the air inside the oven (1), one or more heater (10) that heats the air, a fan cladding (11) located at the back of the cooking chamber (3) that directs the air moved by the fan (9) and one or more bearing surface (5) carrying plates (A, B, C) placed inside the cooking chamber (3) and comprising a take-off piece (17) having one or more window (28) where inlet (7) opens in order to transfer air moved by the fan (9) and directed by the fan cladding (11) inside the duct (6) located on the side walls (4), and deflector plates (19) located on these windows (28) and wherein one or more side wall (4) comprising an inlet (7) that opens to the volume where the fan (9) is located and that lets inside the air moved by the fan (9) and, one or more duct (6) having one or more apertures (8) that provides to blowing air received from the inlet (7) at desired temperature and pressure values, towards the middle and the back of the cooking chamber (3), contacting the top and the bottom surfaces of one or more plate (A, B, C) placed over the bearing surface (5); and wherein the fan cladding (11) which comprises a surface that is placed at the back of the cooking chamber (3) and in front of the fan (9), and sides (15*a* and 15*b*) surrounding this surface and recess (14) that is formed by deep drawing the part that faces the sweeping surface of the fan (9) and a recess edge (16) with a twisted form narrowing from surface towards the base between the surface and the base.

2. An oven (1) according to claim 1, characterized by; the side wall (4) comprises the duct (6) in a form extends inside the cooking chamber (3) and is located along the horizontal axis.

3. An oven (1) according to claim 1 or 2, characterized by; the side wall (4) comprises the duct (6) with apertures (8) having equal shapes and dimensions.

4. An oven (1) according to claim 1 or 2 and characterized by; the side wall (4) comprises the duct (6) with apertures (8) having different shape and dimensions.

5. An oven (1) according to claim 1, characterized by; the side wall (4) comprises the duct (6) with apertures (8) having different dimensions as they get further away from the inlet (7).

6. An oven (1) according to claim 1, characterized by; the side wall (4) comprises the duct (6) having independent inlets (7) that open towards the volume where the fan (9) located.

7. An oven (1) according to claim 1, characterized by; the side wall (4) comprises the duct (6) having inlets (7) connecting to each other as they are open towards the volume where the fan (9) located.

8. An oven (1) according to claim 1, characterized by; the fan cladding (11) comprises the recess edge (16) having a cross-sectional view of an "S" shape.

9. An oven (1) according to claim 1, characterized by; the fan cladding (11) comprises a single or multiple suction apertures (12) in the middle of the recess (14), with various dimension and shapes covering the sweeping area of the fan (9), preferably with a circular cross-section and providing air suction by the fan (9) inside the cooking chamber (3).

10. An oven (I) according to claim 1, characterized by; the fan cladding (11) that opens towards the cooking chamber (3) over the surface and comprises one or more than one blowing aperture (13) located on both sides of the recess (14).

11. An oven (1) according to claim 1, characterized by; the fan cladding (11) comprises an arc which suits the structure of the recess (14) to the sides (15*b*) in order to direct air towards both side walls (4) in equal proportions and one or more side (15*a*) which is the form of a butterfly and that have an incline increasing towards the sides (15*b*), connecting both sides of the arc.

12. An oven (1) according to claim 1, characterized by a fan cladding (11) that comprises side (15*b*) having one or more opening (18) on and that enables the inlet (7) to open towards the volume where the fan (9) is located.

13. An oven (1) according to claim 1, characterized by the fan cladding (11) comprises the take-off piece (17) mounted in a way that it would intersect windows (28) placing on it and openings (18) on the sides (15*b*) of the fan cladding (11).

14. An oven (1) according to claim 1, comprises one or more heater (10) with equal or different power rates that is located in front of the openings (18) formed on the sides (15*b*) of the fan cladding (11) in order to transfer air having different temperature rates inside the cooking chamber (3) when more than one plate (A, B, C) is desired to be heated at different temperature rates.

15. An oven (1) according to claim 1, comprises one or more heater (10) with equal or different power rates that is located in front of the windows (28) placing on the take-off piece (17).

16. An oven (1) according to claim 1, comprises heater (10) with equal or different power rates that are located inside one or more duct (6) placing on the side wall (4).

* * * * *